US006116294A

United States Patent [19]

Willson

[11] Patent Number: 6,116,294

[45] Date of Patent: Sep. 12, 2000

[54] RELIABLE SECURITY SCREEN CONSTRUCTION

[76] Inventor: Clarence P. Willson, 12902 S. Normandie Ave., Gardena, Calif. 90249

[21] Appl. No.: 09/317,515

[22] Filed: May 24, 1999

[51] Int. Cl.[7] ..... B21F 27/12

[52] U.S. Cl. ..... 140/3 R; 140/107

[58] Field of Search ..... 140/3 C, 3 R, 140/71 R, 93 R, 107, 112; 29/433; 139/425 R; 245/1, 2, 8

[56] References Cited

U.S. PATENT DOCUMENTS 1,961,991 6/1934 Southwell ..... 140/112
3,473,577 10/1969 Hornbruch ..... 140/93 R

*Primary Examiner*—Lowell A. Larson
*Attorney, Agent, or Firm*—Leon D. Rosen

[57] ABSTRACT

A method and apparatus are provided for constructing a security screen that includes several parallel security threads woven into a fine screen mesh. Adjacent ends (42, 44) of adjacent security threads (21, 22) are joined together or to a splicing thread (40), to create a continuous strand (60) that extends in a sinuous path through the entire screen mesh, and the continuous strand is used to pull a security wire (64), such as an insulated copper wire through the screen mesh. By joining opposite ends of a long splicing wire to adjacent ends of two security threads, applicant is able to join the security threads into a continuous strand, without cutting away a lot of screen mesh. An end of a security thread is pressure-butt welded to an end of another security thread or to the splicing thread by holding the end of the security thread and pushing in and crinkling the fine screen mesh so the end of the security thread is accessible for welding. Instead of initially weaving Teflon-coated wire into the mesh, applicant weaves aluminum wire.

11 Claims, 3 Drawing Sheets

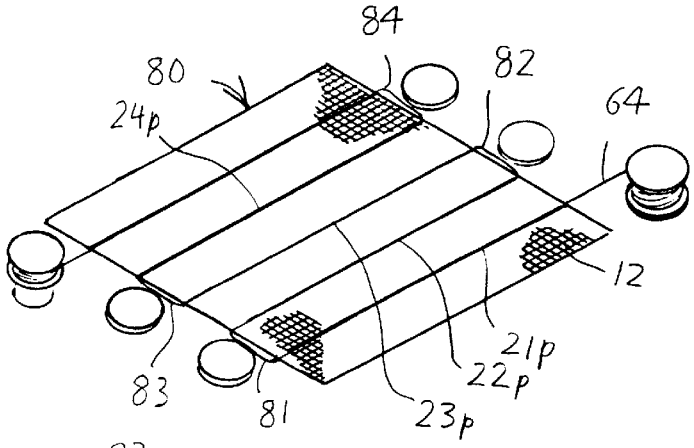
FIG. 5
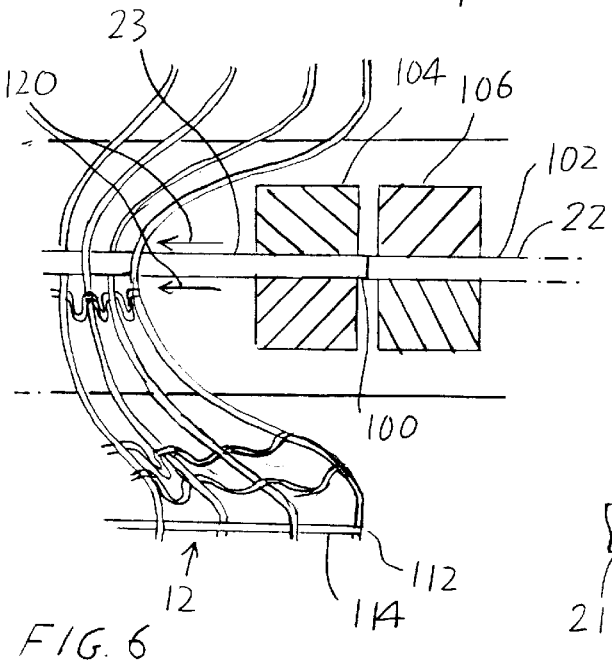
FIG. 6
FIG. 7
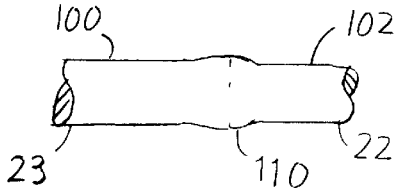
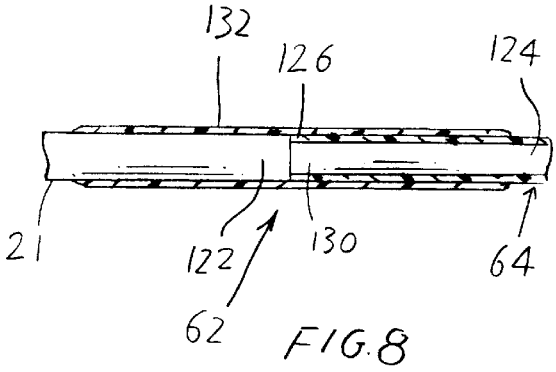
FIG. 8

RELIABLE SECURITY SCREEN CONSTRUCTION

BACKGROUND OF THE INVENTION

Security screens generally include a fine mesh of plastic screen threads, and several conductive security threads woven into the mesh. The security threads consist of Teflon-coated copper. A rectangular piece of security screen is cut from a large roll, and the ends of the security threads are joined to form a series-connected strand in the mesh. In use, a small current passes through the security strand, so an alarm can be sounded if the security strand is cut.

In the prior art, the adjacent ends of each pair of security threads, which are typically four inches apart, have been joined by cutting away screen to leave projecting ends of the security threads. The projecting ends were wrapped and soldered together. The resulting multiple joints, which are generally exposed to the weather, may corrode and greatly decrease the reliability of the security screen.

SUMMARY OF THE INVENTION

In accordance with one embodiment of the present invention, a method and machine are provided for constructing a reliable security screen. The method includes forming a screen with interwoven fine plastic threads that are heat-joined together to form a mesh, the screen having been woven with security threads at four-inch intervals into the mesh prior to heat joining the plastic screen threads. The adjacent ends of pairs of security threads are joined together to form a series-connected continuous strand of security threads (and a splicing thread). A long continuous security wire, such as a copper core covered by insulation, is mechanically attached to one end of the continuous strand. The opposite end of the continuous strand is pulled to pull the security wire into the path previously occupied by the continuous strand of security threads. The result is a security screen containing a single continuous security wire extending in a sinuous path through the mesh, and without multiple joints along the security wire.

In order to join an end of a security thread to another security thread or a splicing thread, the end of the security thread is held while the fine mesh is temporarily pushed in and crinkled, instead of cutting away the mesh.

Applicant initially joins the ends of a long splicing thread to adjacent ends of two security threads. This allows the opposite end of the second thread to be pulled out and directly joined to the third thread, etc. This avoids the need to use a separate splicing thread to join every pair of security thread ends.

The security threads are joined by pressure-butt welding them together. This is a simple procedure which results in a joint that can readily slide through the path previously occupied by a security thread. Instead of weaving Teflon-covered copper wires into the plastic thread mesh to create the woven security threads, applicant weaves aluminum wire to form the security threads. The aluminum wires are easily butt welded to one another, and are of lower cost than the Teflon-coated wires.

The step of pulling the security threads to provide a projecting end of one security thread to weld to the next one, and to pull the security wire through the sinuous path is accomplished by wrapping the continuous strand of security thread around rollers and then pulling the end of the strand.

An apparatus for constructing the security screen includes a bed and a series of rollers along each end of the bed. A pressure butt weld device is preferably provided to slide along each end of the bed to perform welds at that end.

The novel features of the invention are set forth with particularity in the appended claims. The invention will be best understood from the following description when read in conjunction with the accompanying drawings.

BRIEF DESCRIPTION OF THE DRAWINGS

FIG. 5 is a view similar to that of FIG. 4, and showing the substantially completed security screen.

FIG. 6 is an enlarged large plan view of a portion of the screen of FIG. 2, showing how the mesh is compressed and crinkled while an end of a security thread is butt welded to an end of another security thread.

FIG. 7 is an enlarged view of a portion of the security threads of FIG. 6, shown after butt welding.

FIG. 8 is a sectional view of the screen of FIG. 4, showing the connection of an end of the continuous strand of security threads and an end of the security wire.

DESCRIPTION OF THE PREFERRED EMBODIMENT

Figure 1:
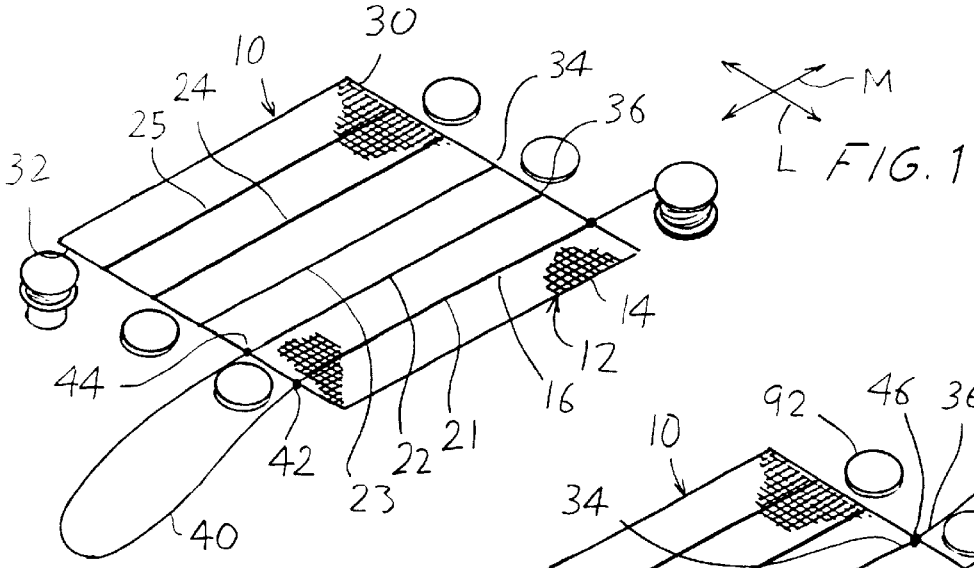
FIG. 1 is a simplified isometric view of apparatus for forming a reliable security screen, and indicating an early step in the screen constructing method.

FIG. 1 illustrates a rectangular screen piece 10 that has been cut from a roll of screen, and which may have a smaller width and length than the screen on the roll. The screen includes a mesh 12 of interwoven screen threads 14, where the screen threads may be spaced by one-sixteenth inch to block insects. It is common to use screen threads that include a fiberglass core and a vinyl coating. The screen piece also includes security threads 16 that are woven into the screen piece when the original roll of screen material was manufactured. A particular screen piece 10 is shown as having five security threads 21–25 that extend parallel to each other and in a longitudinal direction M, and that are spaced apart in a lateral direction L by a standard distance of 4 inches. It may be noted that applicant usually uses an even number of security threads, so the ends of a series joined thread lie on the same end of the screen. The screen piece 10 has first and second ends 30, 32 and each of the security threads 16 have corresponding thread ends that are even or flush with opposite ends of the mesh 12.

In the past, adjacent ends of the security threads, such as the first ends 34, 36 of the two security threads 22, 23, were joined together by cutting away perhaps 6 inches of the screen mesh at each end of the rectangular screen piece. This left projecting security thread ends, to bridge the four-inch gap between the thread ends. The projecting security thread ends were joined, with such joints commonly made by twisting wires around each other and then soldering the twisted wires. For the screen piece of FIG. 1 with five security threads 21–25, this resulted in four joints. Two additional joints were required to connect the ends of the series-connected security thread to electronic equipment that could pass current through the security threads. The joints were sometimes poorly made and subject to corrosion, resulting in less than high reliability.

Figure 2:
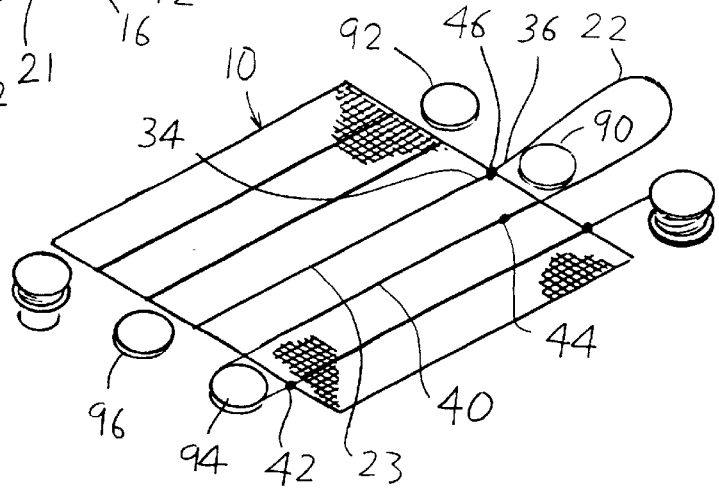
FIG. 2 is a view similar to that of FIG. 1, shown at a later stage in the method.

FIG. 1 illustrates a first step of the present invention, where a long splicing thread 40 is used, which is joined at 42 and 44 to the second ends of the security threads 21, 22. FIG. 2 shows that the second end 36 of the second thread 22 has been pulled out as far as it can go, with the splicing thread 40 occupying the path between the joints 42, 44. A joint 46 is formed between the end 36 of the second security thread 22 and the end 34 of the third security thread 23.

Figure 3:
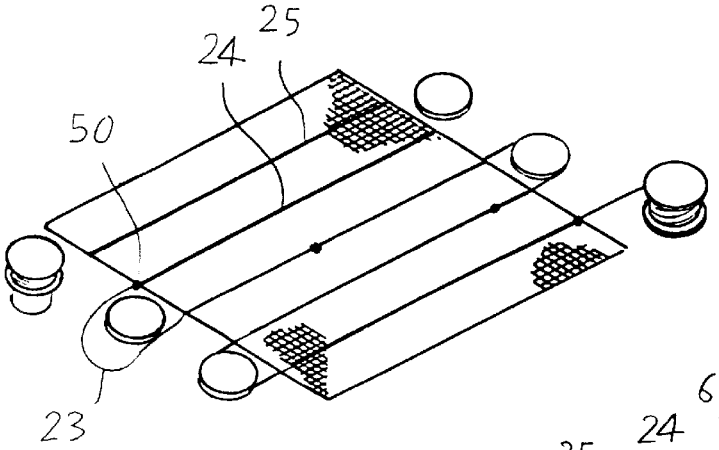
FIG. 3 is a view similar to that of FIG. 2, but showing a later stage in the method.
Figure 4:
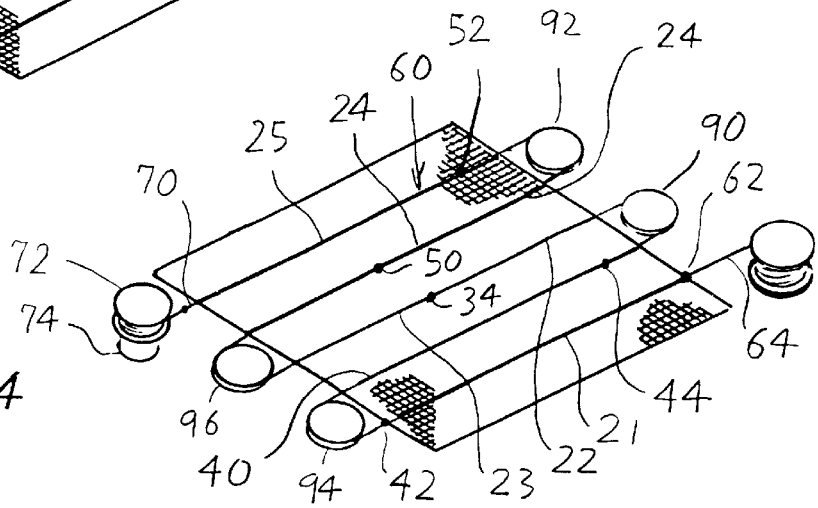
FIG. 4 is a view similar to that of FIG. 3, but showing a later stage in the method.

As shown in FIG. 3, a next step is to pull out the third security thread 23 and join its second end at a joint 50 to the second end of the fourth security thread 24. Next, the fourth security thread 24 is pulled out and joined to the fifth security thread 25. FIG. 4 shows the security threads connected in series with each other and the splicing thread 40, at the joints 42, 44, 34, 50 and to other joints 52, 54. This results in a continuous strand 60 that includes a plurality of security threads connected in series with each other and with at least one splicing thread. The inner end 62 of the continuous strand is connected to a continuous security wire 64 that is to be pulled along the path occupied by the continuous strand 60. The outer end 70 of the continuous strand is connected to a windup roller 72 that is driven by a motor 74. Where the outer end 70 is long enough, it can be directly attached to the roller, and if it is not long enough it can be joined to another wire to connect to the wind-up roller.

FIG. 5 shows the final security screen 80 which includes the mesh 12 and the continuous security wire 64 that extends continually along a sinuous path that occupies the positions 21p–25p previously occupied by the security strands and that extends in tight loops 81–84 between the positions 21p–25p to provide a continuous security wire.

It would be possible to pull the security threads by hand, but applicant prefers to use guide rollers to do this. FIG. 2 shows two guide rollers 90, 92 at the first end of the screen piece, and two other guide rollers 94, 96 at the opposite end of the screen piece. When applicant pulls out the second security thread 22 in FIG. 2, applicant places the splicing thread 40 around the roller 94. Similarly, the other security threads are placed along the other rollers as they are pulled by hand. This results in the splicing thread 40 and the security threads 21–25 extending about the rollers as shown in FIG. 4. When applicant energizes the motor 74, this results in the security wire 64 being pulled into the position occupied by the continuous strand 60. Before completing the pulling of the security wire, applicant progressively detaches the strand of security wire from the rollers, to result in the final security screen 80 of FIG. 5, where the loops 81–84 are relatively short. It is noted that the security screen 80 is mounted by having its edges attached to soft plastic or rubber splines that are inserted into grooves of a screen frame.

Previously, the roll of security screen material from which the screen piece 10 is cut, was formed by weaving an insulated wire comprising a copper core and Teflon insulation, into the woven plastic mesh of fine plastic threads. While the plastic threads of the mesh 12 may have a diameter such as 0.01 inch, the security threads have a diameter such as 0.025 inch. The security screen material was then placed in an oven which heated it to a temperature at which the plastic threads melted into one another, as where the vinyl coatings on fiberglass cores melted together. The Teflon insulation on the copper core has a high melting temperature and did not melt. A Teflon insulation greatly adds to the cost of the security threads. Applicant prefers to have an aluminum wire woven into the plastic mesh whose threads melt into one another at a temperature such as a few hundred degrees F; at that temperature the aluminum wire does not melt and therefore it later can slide along the sinuous path formed by weaving the aluminum wire into the mesh. One advantage of using aluminum wire is that its cost is much less than that of a Teflon insulated wire. A second advantage is that it is easy to pressure butt weld the ends of a pair of aluminum wires.

FIG. 6 shows the ends 100, 102 of two security threads 22, 23 being butt welded together. Each of the ends is placed in a clamp 104, 106 and the clamps are then forcibly moved together. The very high compressive forces on the aluminum wire ends results in them being butt welded together as is known in the prior art. FIG. 7 shows a pressured butt weld 110 which results in a weld with a smooth exterior and with a diameter about the same as the diameters of the threads 22, 23 that were butt welded together. An example of a butt welding machine is described later in connection with FIG. 9.

Initially, the end 100 (FIG. 6) of each security thread such as 23 is even or flush with the ends 112 of the plastic screen threads 113 that form the mesh 12. This results from simple cutting into a rectangular shape. In order to join the end 100 of the security thread, it must protrude from the surrounding mesh. It would be possible to cut away the mesh 12 around the end of the security threads, and join the projecting ends together. However, this would require additional labor, and would result in wasting perhaps six inches of screen mesh at each end. Instead, applicant presses inward, as shown by arrows 120 against the mesh, resulting in crinkling it and leaving the end 100 of the security thread free of close surrounding by the mesh so the end of the security thread can be joined as by butt welding.

FIG. 8 shows a joint 62 where a first end 122 of security thread 21 is joined to the security wire 64 that includes a core portion 124 of electrically conductive material such as copper and an insulation 126. Although a Teflon insulation can be used, Teflon is not required here because the insulation of the security wire does not have to withstand a high temperature at which the plastic screen threads melt. Instead, a lower cost plastic such as vinyl, can be used. The ends 122, 130 are joined by placing a heat shrink sleeve 132 around them, as shown, and then heating the sleeve to contract it tightly around the ends of the security thread and security wire. Care has to be taken in such a joint to assure that it will smoothly slide through the paths previously occupied by the security threads. It generally requires considerably more time to install the sleeve 132 than to make the pressure butt weld 110 of FIG. 7.

Figure 9:
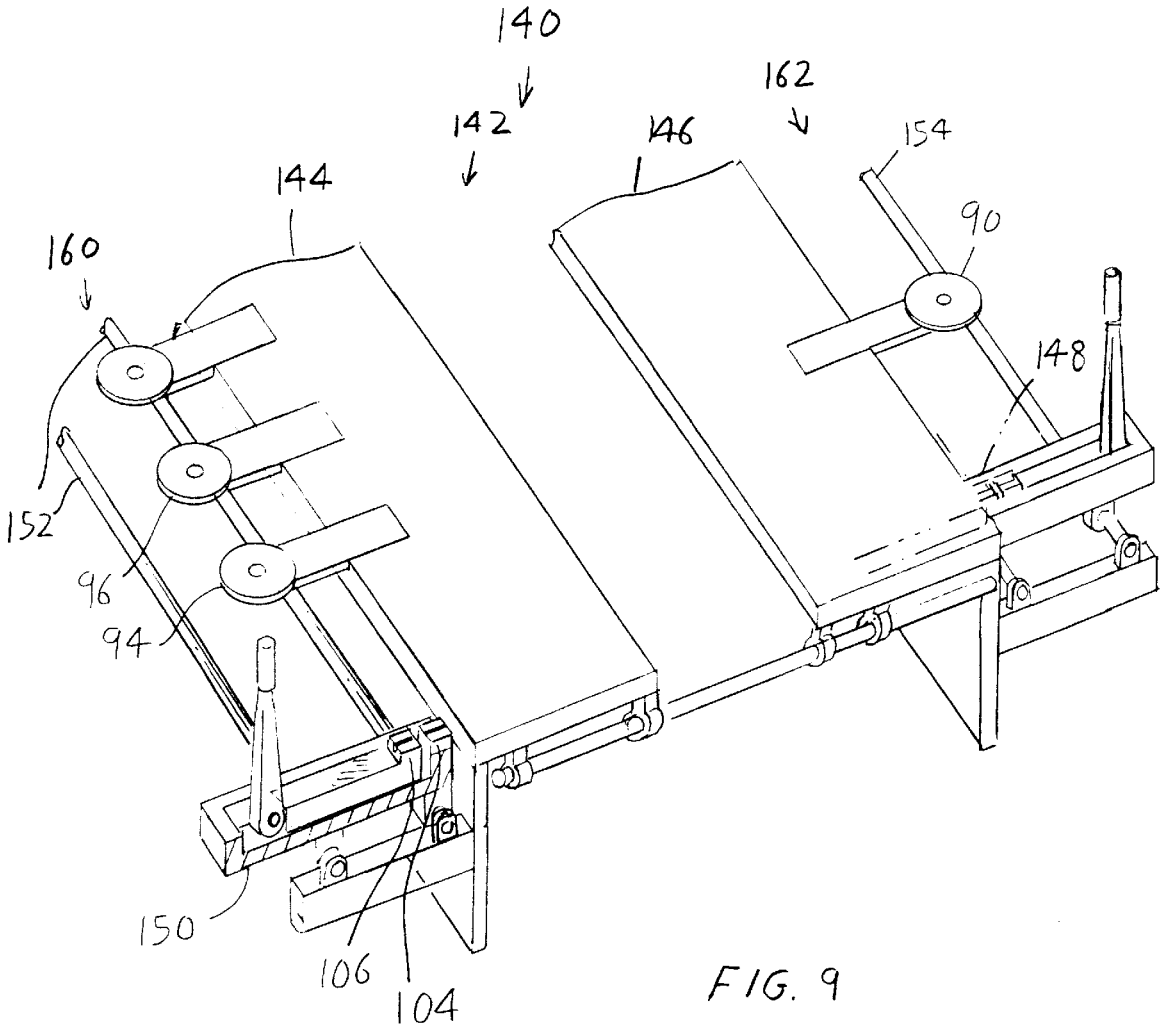
FIG. 9 is a partial isometric view showing an apparatus for performing the method steps of FIGS. 1–8.

FIG. 9 shows apparatus 140 that applicant uses to construct the screen of FIGS. 1–8. The apparatus includes a bed 142 with two bed sections 144, 146 that can be moved apart and together to accommodate a screen piece of a range of lengths. A holddown 148 holds the screen down to the bed. The rollers such as 90, 94, 96 are mounted on the opposite bed sections, with preferably at least three rollers at either side to accommodate a screen piece of large width. A thread handler 160, 162 at each bed section includes a butt welder and a lateral guide. A pressure butt welder 150 that includes the clamps 104, 106, is mounted to slide along a guide 152 formed by a pair of rails, to weld security threads adjacent to any of the rollers. Another butt welder 164 slides along another guide at the other end of the bed.

In the method of FIG. 1, applicant uses a long splicing thread 40. However, it would be possible to instead use four shorts splicing threads to connect the security threads 21–25 in series. However, this would require eight joints where the splicing threads are connected to the ends of the security threads, instead of only two joints at the ends of the long splicing thread 40 and three additional joints. It is also possible to not use rollers but to hand-pull the threads, although this is more labor intensive, especially when the continuous security wire 64 is pulled through the entire paths of the five security threads Although applicant prefers to weave a bare aluminum wire into the original security screen, it is possible to use other metals for pressure butt welding. It is also possible to use a high temperature plastic, such as Teflon, preferably in a solid wire, which can be ultrasonically welded to a tip of another Teflon wire, although this is expensive.

Thus, the invention provides a method and apparatus for producing a highly reliable security screen in a practical and moderate cost method. Security threads of material that can withstand the temperatures at which the woven plastic threads are melted together, are woven into the original woven mesh. The method includes joining pairs of security threads together at their ends, to form a continuous strand comprising a plurality of security threads and preferably with a long splicing thread (several short splicing threads can be used although not preferred). A continuous security wire which includes a core of electrically conductive material such as copper and surrounding insulation, is joined to an end of the continuous strand, and the continuous strand is pulled out to pull the continuous wire into its place. When a screen piece is cut from a larger roll of screen material, the tips of the screen are left even, or flush, with the ends of the mesh, and access to the ends of security threads is obtained by pushing in the mesh and crinkling it. Applicant preferably uses a long splicing thread to join the ends of two security threads, and thereafter pulls out the ends of security threads to extend them to the end of another thread to weld thereto. The joining of security threads and splicing thread is preferably obtained by pressure butt welding, which is especially useful for moderate melting temperature metals such as aluminum. The security threads are preferably wrapped around rollers, to facilitate pulling a continuous strand of the series-connected security threads so a continuous security wire can be pulled into the places previously occupied by the security threads. Apparatus for carrying out the method preferably includes a bed with rollers at opposite ends of the bed, and with a pressure butt welder at each end that can slide to different positions along the end.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for constructing a reliable security screen, comprising:

forming a screen piece with opposite ends, that includes interwoven screen threads that are joined together at their intersections, and that includes a plurality of security threads that are woven into said screen piece and that are parallel to one another and spaced apart by many times the spacing of adjacent screen threads of said screen piece, with said security threads having security thread ends at opposite ends of said screen piece;

joining pairs of said security thread ends at each of said ends of said screen piece to form a continuous strand comprising a plurality of security threads that extends in a sinuous path with said continuous strand having inner and outer opposite ends;

joining an end of continuous security wire that includes at least a core portion that is electrically conductive, to said inner end of said continuous strand that comprises a plurality of security threads, and pulling said outer end of said continuous strand of security threads to pull said security wire into the positions occupied by said security threads.

2. The method described in claim 1 wherein:

said step of forming a screen piece includes leaving opposite ends of said security threads flush with opposite ends of said screen threads that are joined at their intersections;

said step of joining pairs of said security thread ends includes holding an end of a security thread while temporarily pushing in and crinkling a section of said screen piece which is formed of said screen threads, and while joining a thread to said held end of a security thread.

3. The method described in claim 1 wherein:

said step of joining pairs of said security thread ends includes joining a long splicing thread to the second ends of first and second adjacent security threads where said second ends lie at the same second end of said screen piece, and pulling an opposite first end of said second security thread out of said first end of said screen piece and extending said first end of said second security thread to a first end of a third of said security threads.

4. The method described in claim 1 wherein:

said step of joining pairs of security threads includes pressure butt welding an end of one of said security threads to an end of another thread.

5. The method described in claim 1 wherein:

said step of weaving security threads includes weaving strands of bare metal wire into said interwoven screen threads to form bare metal wire security threads;

said step of joining pairs of said security thread ends includes pressure butt welding an end of each bare metal wire security thread to another thread of bare metal wire.

6. The method described in claim 1 wherein:

said step of pulling includes establishing a plurality of rollers adjacent to said opposite ends of said screen piece, and extending parts of said continuous strand of security threads which emerges from an end of said screen piece, around said rollers.

7. A method for constructing a reliable security screen, comprising weaving medium-temperature melting flexible plastic threads into a mesh with opposite ends and weaving a plurality of parallel high-temperature security threads into said mesh during weaving of said mesh to leave a plurality of spaced parallel security threads with opposite ends in said mesh;

heating said mesh with said security threads therein to bind said plastic threads together into a flexible cloth while leaving said security threads free to slide along their lengths within said cloth;

splicing certain adjacent pairs of ends of said security threads to leave a continuous security thread structure that extends in a sinuous path previously occupied by separate ones of said security threads;

attaching a security wire to one end of said continuous security thread structure and pulling an opposite end of said continuous security thread structure, to pull said security wire into the position previously occupied by said continuous security thread structure;

said step of splicing including sliding only a portion of said cloth which surrounds an end portion of a security thread along the security thread while crinkling the cloth to leave the end portion of the security thread exposed for splicing.

8. The method described in claim 7 wherein:

said step of splicing includes joining a long splicing thread to a second end of a first security thread, and pulling an opposite first end of said first security thread out of a first end of said screen piece and directly joining said first end of said first security thread to a first end of a second thread.

9. The method described in claim 7 wherein:

said step of joining pairs of security threads includes pressure butt welding an end of one of said security threads to an end of another security thread.

10. Apparatus for forming a reliable security screen, comprising:

a bed with a pair of longitudinally-spaced opposite ends, for supporting a screen piece that includes a woven screen with parallel longitudinally-extending security threads that each has opposite ends, with one of said bed ends being moveable toward and away from the other end to accommodate screen pieces of different lengths;

each of said bed ends including a guide track extending in a lateral direction that is perpendicular to said longitudinal direction, and a pressure butt welder moveable to different positions along said guide track.

11. The apparatus described in claim 10 wherein:

each of said bed ends includes a plurality of rollers with axes extending perpendicular to said longitudinal and lateral directions, with said roller axes being laterally spaced apart by about 4 inches to guide movement of said security threads in a sinuous path through the positions of other security threads that were laterally spaced apart by 4 inches in said screen piece.

* * * * *